US007062922B1

(12) United States Patent
Kirkconnell et al.

(10) Patent No.: US 7,062,922 B1
(45) Date of Patent: Jun. 20, 2006

(54) CRYOCOOLER WITH AMBIENT TEMPERATURE SURGE VOLUME

(75) Inventors: Carl S. Kirkconnell, Huntington Beach, CA (US); Kenneth D. Price, Long Beach, CA (US); Michael C. Barr, Torrance, CA (US); Anthony T. Finch, Hawthorne, CA (US)

(73) Assignee: Raytheon Company, Waltham, MA (US)

( * ) Notice: Subject to any disclaimer, the term of this patent is extended or adjusted under 35 U.S.C. 154(b) by 215 days.

(21) Appl. No.: 10/762,867

(22) Filed: Jan. 22, 2004

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 5,642,623 | A | 7/1997 | Hiresaki et al. | |
| 5,647,219 | A * | 7/1997 | Rattray et al. | 62/6 |
| 5,711,157 | A | 1/1998 | Ohtani et al. | |
| 6,167,707 | B1 * | 1/2001 | Price et al. | 62/6 |
| 6,205,812 | B1 * | 3/2001 | Acharya et al. | 62/607 |
| 6,256,998 | B1 * | 7/2001 | Gao | 62/6 |
| 6,330,800 | B1 | 12/2001 | Price et al. | |
| 6,374,617 | B1 * | 4/2002 | Bonaquist et al. | 62/6 |
| 6,378,312 | B1 * | 4/2002 | Wang | 62/6 |
| 6,666,033 | B1 * | 12/2003 | Swift et al. | 62/6 |
| 2004/0000149 | A1 * | 1/2004 | Kirkconnell et al. | 62/6 |
| 2004/0168445 | A1 * | 9/2004 | Kunitani et al. | 62/6 |
| 2004/0221586 | A1 * | 11/2004 | Daniels | 62/6 |

OTHER PUBLICATIONS

U.S. Appl. No. 10/288,943, filed Nov. 6, 2002, entitled Multi-Nozzle Grid Missile Propulsion System.

* cited by examiner

*Primary Examiner*—William C. Doerrier
(74) *Attorney, Agent, or Firm*—John E. Gunther; Leonard A. Alkov; Karl A. Vick

(57) ABSTRACT

A two-stage cryocooler (10) includes an ambient temperature portion (12), a first-stage temperature portion (14), and a second-stage temperature portion (16). The ambient temperature portion includes a surge volume (44) that is coupled to and in communication with the first-stage temperature portion. The surge volume may be coupled to a first-stage interface (36) of the first-stage temperature portion by use of an inertance tube (42). Locating the surge volume in the ambient temperature portion may advantageously reduce size and mass of the first-stage temperature portion. Also, thermal losses may be reduced by maintaining the surge volume at ambient temperature. Space and structural requirements for maintaining the system may be met more easily with the surge volume maintained in the ambient temperature portion of the two-stage cooler. The surge volume may be a separate unit, or may be a plenum or other chamber within an expander in the ambient temperature portion.

21 Claims, 8 Drawing Sheets

CRYOCOOLER WITH AMBIENT TEMPERATURE SURGE VOLUME

BACKGROUND OF THE INVENTION

1. Technical Field

The present invention relates generally to cryocoolers, and more particularly, to two-stage cryocoolers having a Stirling/pulse tube hybrid configuration.

2. Description of the Related Art

Multistage cryocoolers are of fundamental interest for many applications in which cryogenic cooling is required. For example, some applications require the simultaneous cooling of two objects to cryogenic, but different, temperatures. In the case of a long wave infrared sensor, for instance, the focal plane assembly may require an operating temperature of around 40 K., while the optics may need to be maintained at a different temperature, such as about 100 K. One approach for such situations is to use a single-stage cooler and extract all of the refrigeration at the coldest temperature. However, this is thermodynamically inefficient. Another approach is to use two single-stage cryocoolers with one each at the two temperature reservoirs. This approach has the disadvantage of being expensive and large in size. A better approach that has been done in the past is to use a two-stage cryocooler with the first-stage cooling of the higher operating temperature component, and the second stage cooling the lower operating temperature component. Multistage cryocoolers are generally more efficient than single-stage coolers, because a portion of the internal parasitic thermal losses can occur at higher temperatures, thus producing less entropy generation.

Space-based cryocooler requirements put a high premium upon small volume, low weight, and high reliability. One approach that has been taken in the past is to use a two-stage cryocooler with a first-stage Stirling cryocooler, and a second-stage pulse tube cryocooler. Such an arrangement provides high efficiency, long life, and compact size for the system. Examples of such systems may be found in co-owned U.S. Pat. Nos. 6,167,707 and 6,330,800. Other and viable multistage configurations include multistage Stirling cryocoolers and multistage pulse tubes.

While some success has been achieved with the prior approaches described above, it will be appreciated that improvements may be desirable, as is generally the case in the vast majority of technical areas.

SUMMARY OF THE INVENTION

According to an aspect of the invention, a cryocooler includes a surge volume that is maintained at a temperature while being in communication with an interface maintained at another, lower temperature. The surge volume may be maintained at ambient temperature while the interface may be maintained at a temperature below ambient.

According to another aspect of the invention, a hybrid multistage cryocooler includes: a first-stage expander having a first-stage expander outlet; a first-stage thermal interface; a second-stage expander in communication with the first-stage expander outlet, via the first-stage thermal interface; and a surge volume in gaseous communication with the second-stage expander outlet. The surge volume is maintained at an ambient temperature.

According to yet another aspect of the invention, a hybrid multistage cryocooler includes: a first-stage expander having a first-stage expander outlet; a first-stage thermal interface; a second stage in communication with the first-stage expander outlet, via the first-stage thermal interface; a surge volume in gaseous communication with the second-stage expander; and an inertance tube coupling the surge volume to the second-stage outlet. The surge volume is maintained at an ambient temperature. A first end of the inertance tube is at the ambient temperature. A second end of the inertance tube is at a first-stage temperature, which is lower than the ambient temperature. The first-stage expander is a Stirling expander. The first-stage thermal interface is coupled to an expansion volume of the first-stage expander. The first-stage thermal interface is cantilevered from a first-stage cold cylinder.

According to a further aspect of the invention, a method of cooling includes the steps of providing a first-stage expander having a first-stage expander outlet; providing a first-stage thermal interface; providing a second stage in communication with the first-stage expander outlet, via the first-stage thermal interface; and coupling a surge volume in communication with the second-stage expander outlet, wherein the coupling includes placing the surge volume such that the surge volume is maintained at an ambient temperature.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, which are not necessarily to scale.

DETAILED DESCRIPTION

A two-stage cryocooler includes an ambient temperature portion, a first-stage temperature portion, and a second-stage temperature portion. The ambient temperature portion includes a surge volume that is gaseously coupled to a second-stage outlet, and thus in thermal communication with the first-stage temperature portion. The surge volume may be coupled to the second-stage outlet by use of an inertance tube. Locating the surge volume in the ambient temperature portion may advantageously reduce the size and mass of the first-stage temperature portion. Also, thermal losses may be reduced by maintaining the surge volume at ambient temperature. Space and structural requirements for maintaining the system may be met more easily with the surge volume maintained in the ambient temperature portion of the two-stage cooler. The surge volume may be a separate unit, or may be a plenum or other chamber within an expander in the ambient temperature portion.

Figure 1:
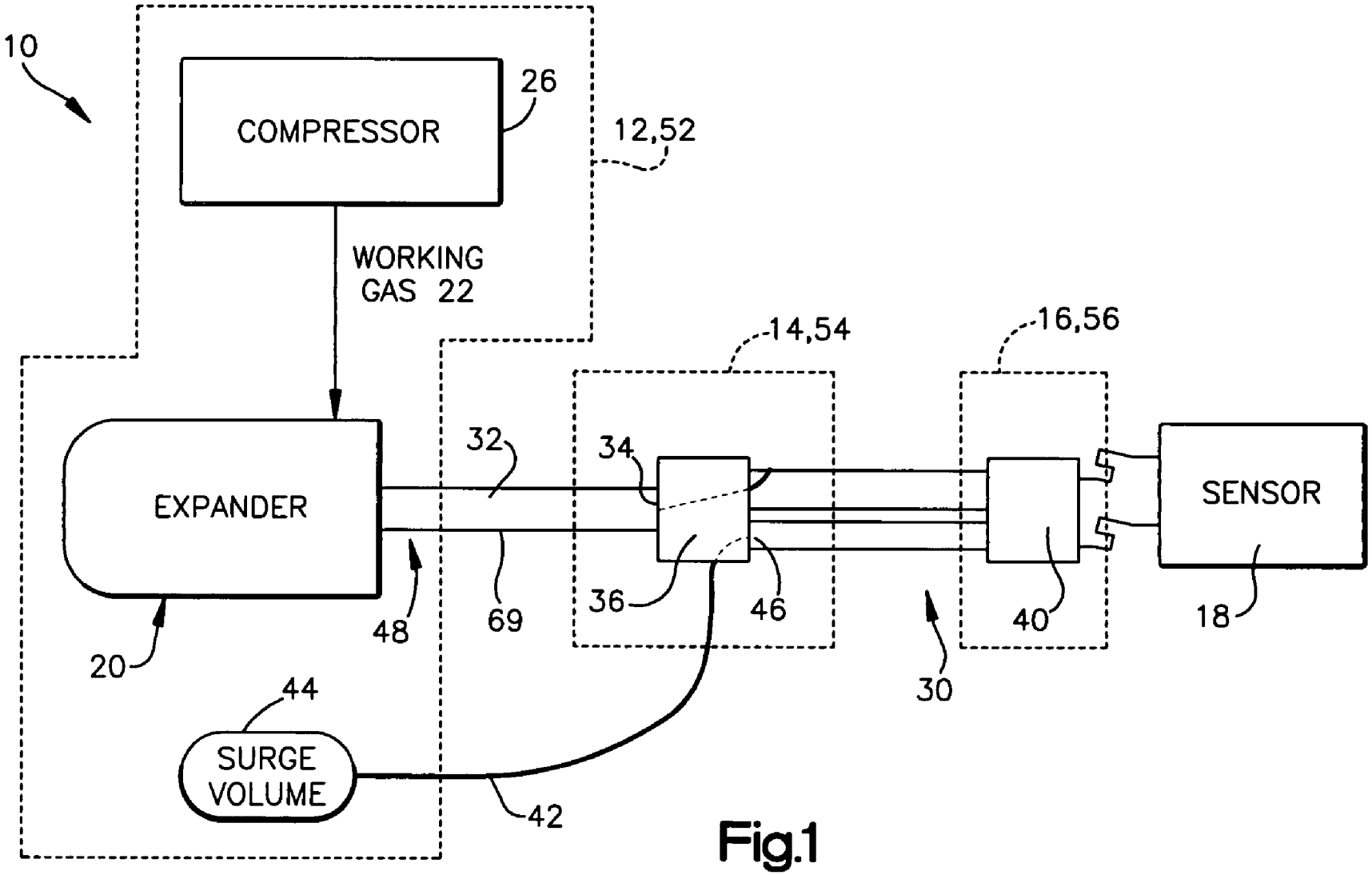
FIG. 1 is a schematic diagram of a cryocooler in accordance with the present invention.

FIG. 1 schematically illustrates a two-stage cryocooler. Certain aspects of the cryocooler 10 may be similar to corresponding aspects described in U.S. Pat. Nos. 6,167,707 and 6,330,800, the descriptions of which are incorporated herein by reference. The cryocooler 10 includes an ambient temperature portion 12, a first-stage temperature portion 14, and a second-stage temperature portion 16. The second-stage temperature portion is coupled to a component to be cooled, such as a sensor 18. The first-stage of the cryocooler 10 includes a Stirling expander 20 for providing cooling by expanding a working gas 22 compressed by a compressor 26. The second stage of the cryocooler 10 is a pulse tube expander 30.

In an outline of general operation of the system, the compressor 26 supplies the compressed working gas 22 such as helium, to the first-stage Stirling expander 20. The working gas is expanded into an expansion volume 32. The working gas flows from the expansion volume 32 through a Stirling expander outlet 34, through a first-stage interface 36, and into the second-stage pulse tube expander 30. A second-stage thermal interface 40 is provided between the second-stage pulse tube expander 30 and a heat load in the form of the component to be cooled, such as the sensor 18.

An inertance tube 42 is coupled on one end to the first-stage interface 36, and on another, opposite end to a surge volume 44 that is a part of the ambient temperature portion 12. The first-stage interface 36 is in gaseous communication with a second-stage outlet 46. The inertance tube 42 and the surge volume 44 provide modulation and control in the operation of the cryocooler 10. The inertance tube 42 and the surge volume 44 combine to reduce a phase shift in the operation of the cryocooler 10, to reduce the phase angle between a pressure wave and the cold end flow rate in the pulse tube expander 30. The characteristics of the inertance tube 42, such as the diameter and length of the inertance tube 42, may be selected so as to achieve a desired performance within the cryocooler. The desired performance may include a goal of minimizing the phase angle between the mass flow rate and the pressure wave at the cold end of the pulse tube 30, with an ultimate objective of optimizing thermodynamic efficiency.

The ambient temperature portion 12 includes a warm end 48 of the Stirling expander 20, as well as the compressor 26 and the surge volume 44. The components of the ambient temperature portion 12 may be coupled to an ambient temperature structure 52. The first-stage temperature portion 14 includes the first-stage interface 36, which may be coupled to a first-stage structure 54. The second-stage portion 16 includes the second-stage thermal interface 40, which may be coupled to a second-stage temperature structure 56. The first-stage interface 36 may be supported in a cantilevered structure by the thin-walled tube of the expansion volume 32.

Figure 2:
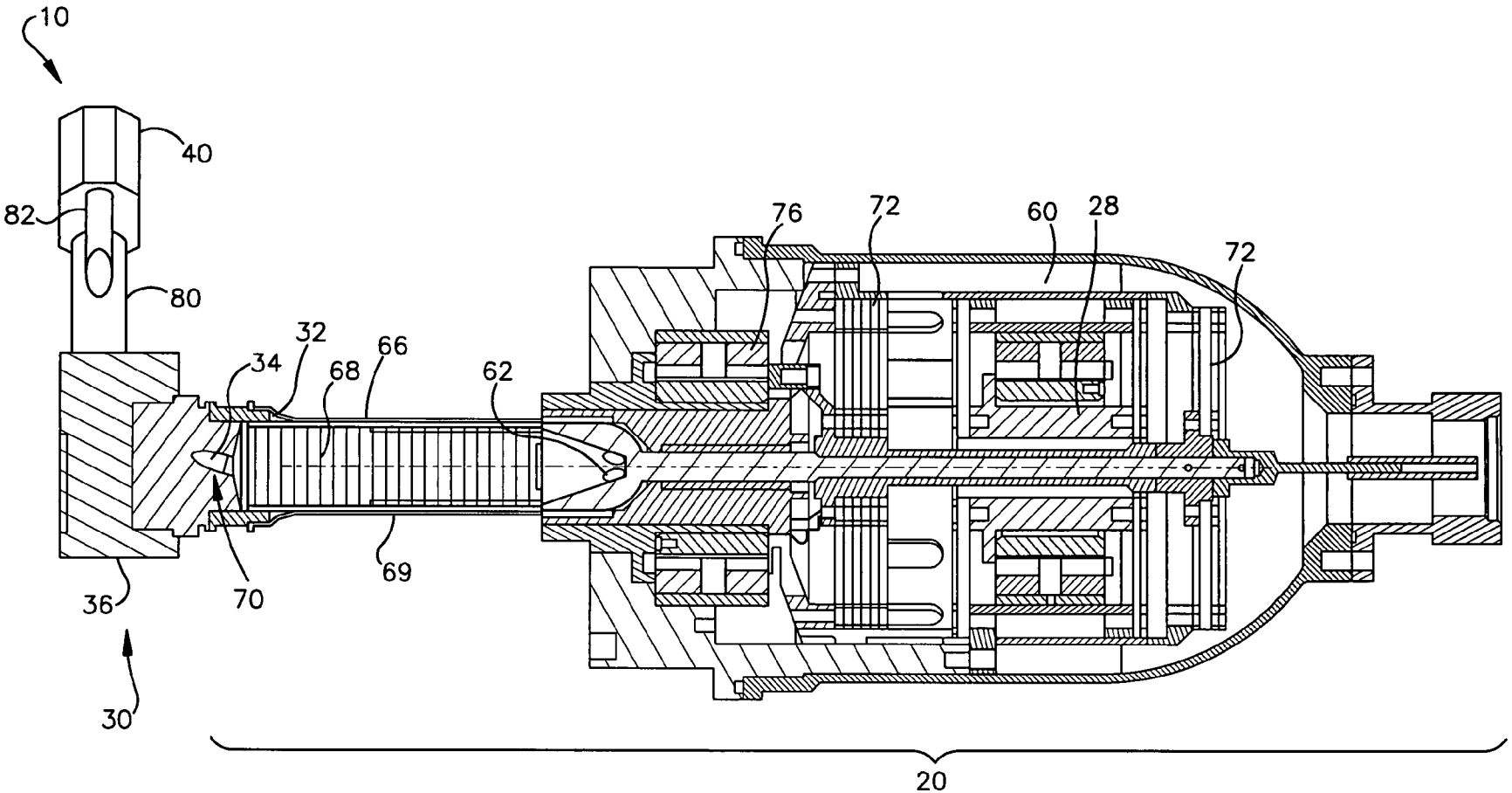
Fig.2 PRIOR ART
FIG. 2 is a sectional view of details of a prior art Stirling expander and pulse tube expander.
Figure 3:
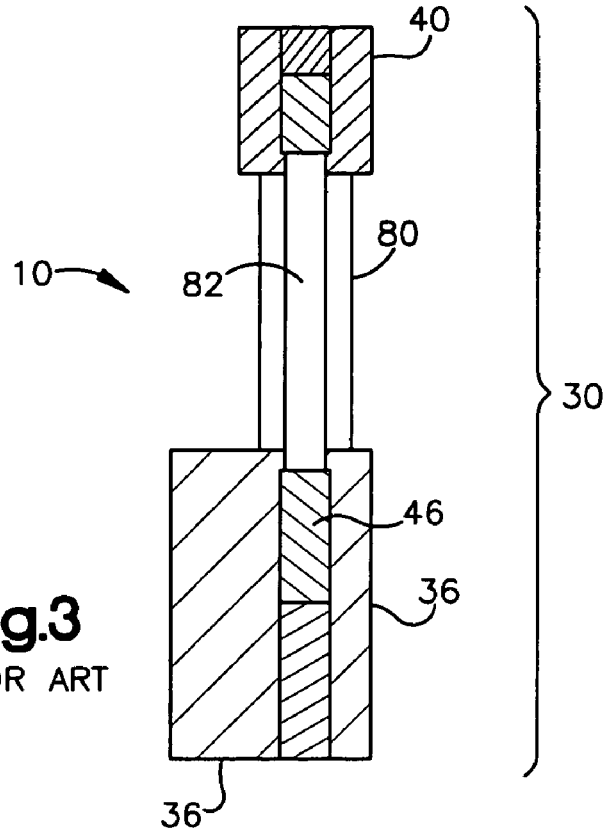
Fig.3 PRIOR ART
FIG. 3 is a sectional view of details of a prior art pulse tube expander.
Figure 4:
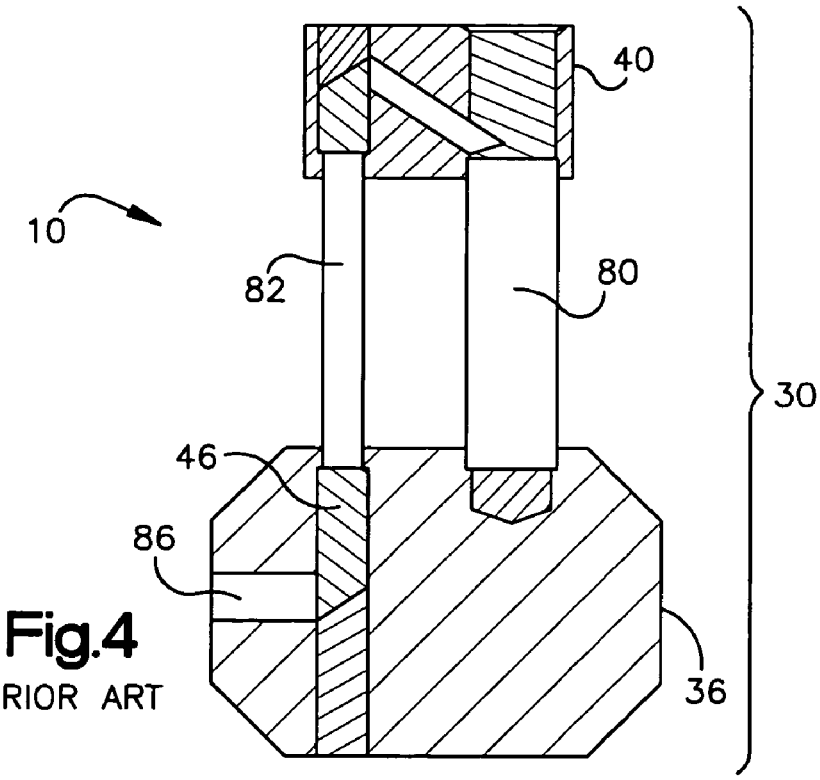
Fig.4 PRIOR ART
FIG. 4 is another sectional view of the pulse tube expander of FIG. 3.

Referring now to FIGS. 2–4, some details are shown of the structure of the Stirling expander 20 and the second-stage pulse tube expander 30. The Stirling expander 20 has a plenum 60 and a cold head that includes a thin-walled cold cylinder, an expander inlet 62 disposed at a warm end of a first-stage regenerator 68, a moveable piston or displacer 66 disposed within a cold cylinder 69, and a heat exchanger 70. The displacer 66 is suspended on fore and aft flexures 72. The displacer 66 is controlled and moved by using a motor 76 located at a fore end of the plenum 60. A flexure-suspended balancer 78 may be used to provide internal reaction against the inertia of the moving displacer 66.

The second-stage pulse tube expander 30 includes a second-stage regenerator (regenerative heat exchanger) 80, and a pulse tube 82. The second-stage regenerator 80 and the pulse tube 82 are gaseously coupled at one end to the second-stage interface 40. Both the second-stage regenerator 80 and the pulse tube 82 are physically connected to the first-stage interface 36 at an opposite end, but are not in direct communication with each other. The first-stage interface 36 has a port 86 that is connected to the second-stage outlet 46. One end of the inertance tube 42 is coupled to the port 86.

In operation of the cryocooler 10, a gas, for instance helium, flows into the expander inlet 62, and into the first-stage regenerator 68 and the heat exchanger 70. Gas flowing into the cold volume within the expander 20 is regenerated by the first-stage regenerator 68. A portion of the gas remains in the first-stage expansion volume of the first-stage regenerator 68. Progressively smaller portions of the gas continue to the second-stage regenerator 80, the pulse tube 82, and the inertance tube 42 in the surge volume 44.

The use of a relatively long inertance tube 42 allows the advantage of moving the surge volume 44 to the ambient temperature portion 12 of the cryocooler 10, while simultaneously providing the required fluidic resistance and inductance to achieve the desired phase shift. In the past, surge volumes in Stirling/pulse tube hybrid cryocoolers have been maintained at a cold temperature, and have been mounted more or less directly on structure of a cold stage. Since the cold stages of a cryocooler may be suspended in an essentially cantilevered configuration, with the expander 20 supported, and other components of the cryocooler having to support their own weight in a cantilevered configuration, it is highly advantageous to shift the surge volume to the ambient portion of the cryocooler, where it is much more easily supported. The cantilevered structure of the cryocooler 10 may involve use of a fairly long, thin-walled tube (e.g., the cold cylinder 69) as a support. It will be appreciated that the greater amount of mass on the cantilevered structure, the greater the amount of stress that is put at the joint at the base of the thin-walled tube. Thus, by reducing the mass on the cantilevered structure, mechanical stresses in the cryocooler 10 may be reduced. Reducing the mass at the end of the cold cylinder 69 increases the natural frequency of the thin-walled tube that is the cold cylinder, which tends to make the dynamic response of the cryocooler 10 to loads such as vibrations from a space launch less severe. In addition, reducing the amount of size that must be maintained at the cryogenic first-stage temperature decreases the parasitic radiative load on the first stage, and thus increases the system cooling of objects or components to be cooled, that the cryocooler 10 may provide.

In addition, moving the surge volume from the first-stage temperature portion to the ambient temperature portion may be advantageous from the point of view of packaging volume. Often, there is a tight constraint on the amount of available packaging volume within a cryogenic space. Volume availability of ambient space is almost always less constraining. Moving the surge volume to the ambient temperature portion of a cryocooler, where volume is much less constrained, may be a major benefit in the design process.

Further, as pointed out above, moving the surge volume to the first-stage temperature portion reduces the cryogenic surface area, which may thereby reduce radiative parasitic losses.

Another potential benefit of the cryocooler 10 is that entropy generated due to frictional loss in the inertance tube 42 may also be reduced. It will be appreciated that the inertance tube 42 is not maintained at a single temperature. One end of the inertance tube 42 is coupled to the first-stage interface 36, at the first-stage temperature. The opposite end of the inertance tube 42 is coupled to the surge volume 44, at an ambient temperature. Therefore, at least part of the inertance tube 42 is at a higher temperature than the first-stage temperature portion 14, due to the shifting of the surge volume 44 from the first-stage temperature portion 14 to the ambient temperature portion 12. Operation of the cryocooler 10 involves frictional losses within the inertance tube 42. These frictional losses generate entropy. Since the amount of entropy generated for a given amount of heating is inversely proportional to the temperature, it will be appreciated that raising the operating temperature of at least a portion of the inertance tube 42 reduces the amount of entropy created.

In addition, heat generated due to friction within the inertance tube 42 has multiple thermal paths through which it may be removed. One thermal path is at the first-stage temperature, by coupling to the first-stage interface 36. Another thermal path is to the ambient surroundings. Providing multiple thermal paths, including a path to remove friction-generated heat at ambient temperature, may also be advantageous in terms of efficiently using the cooling generated by the cryocooler 10.

Figure 5:
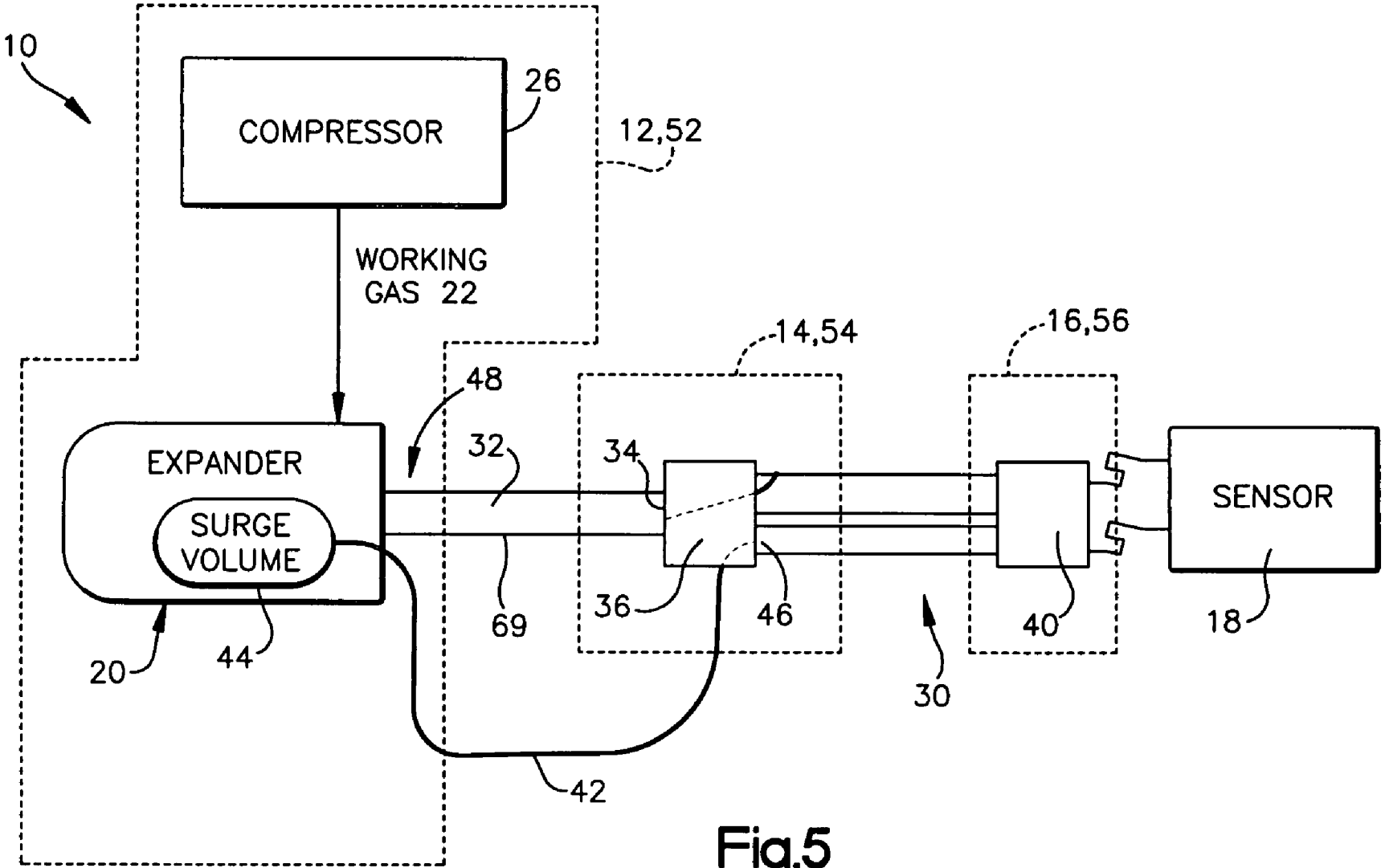
FIG. 5 is a schematic diagram of an alternate embodiment cryocooler in accordance with the invention.
Figure 6:
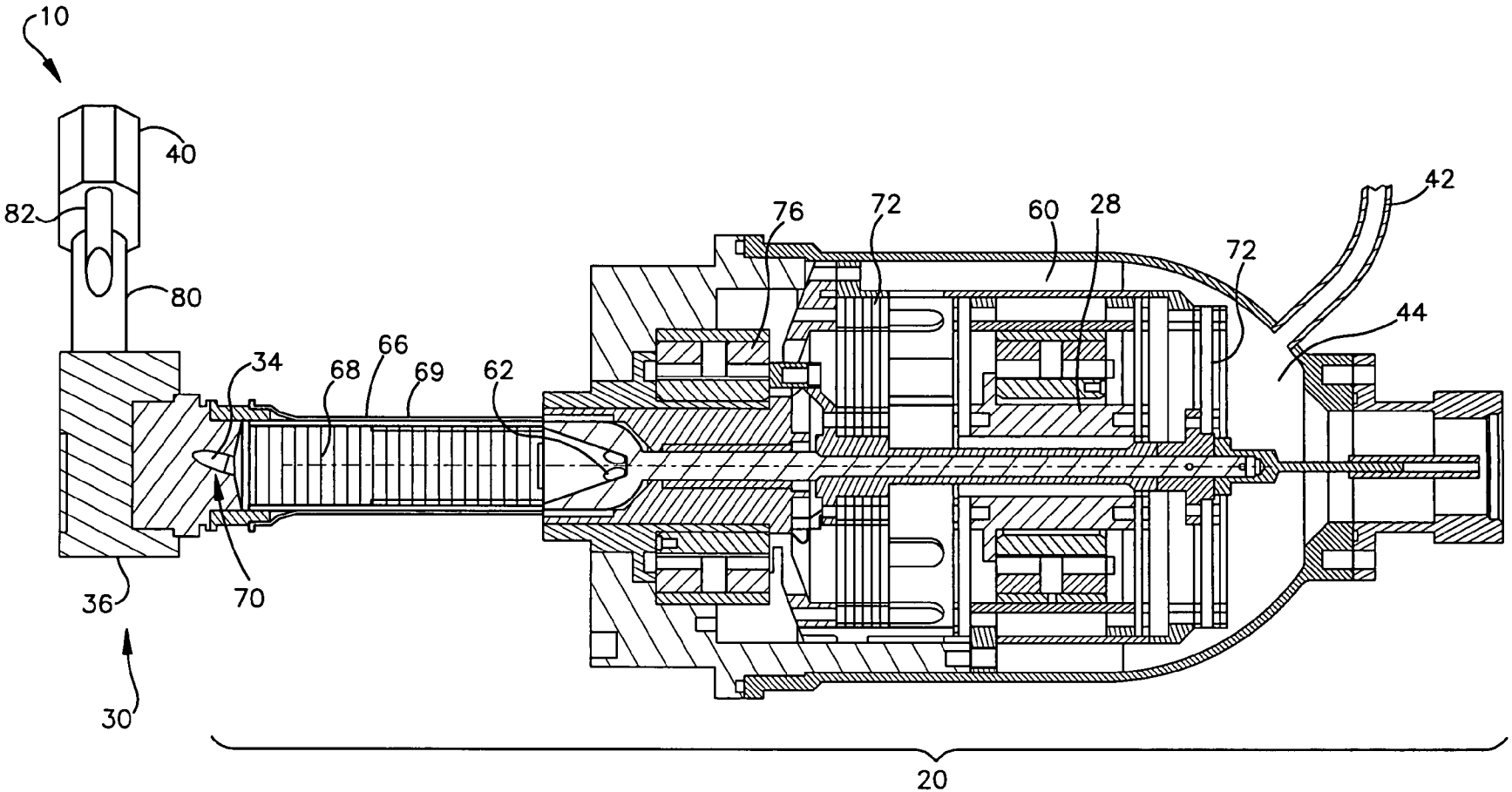
FIG. 6 is a cross-sectional view of one specific embodiment of a Stirling expander for the cryocooler of FIG. 5.
Figure 7:
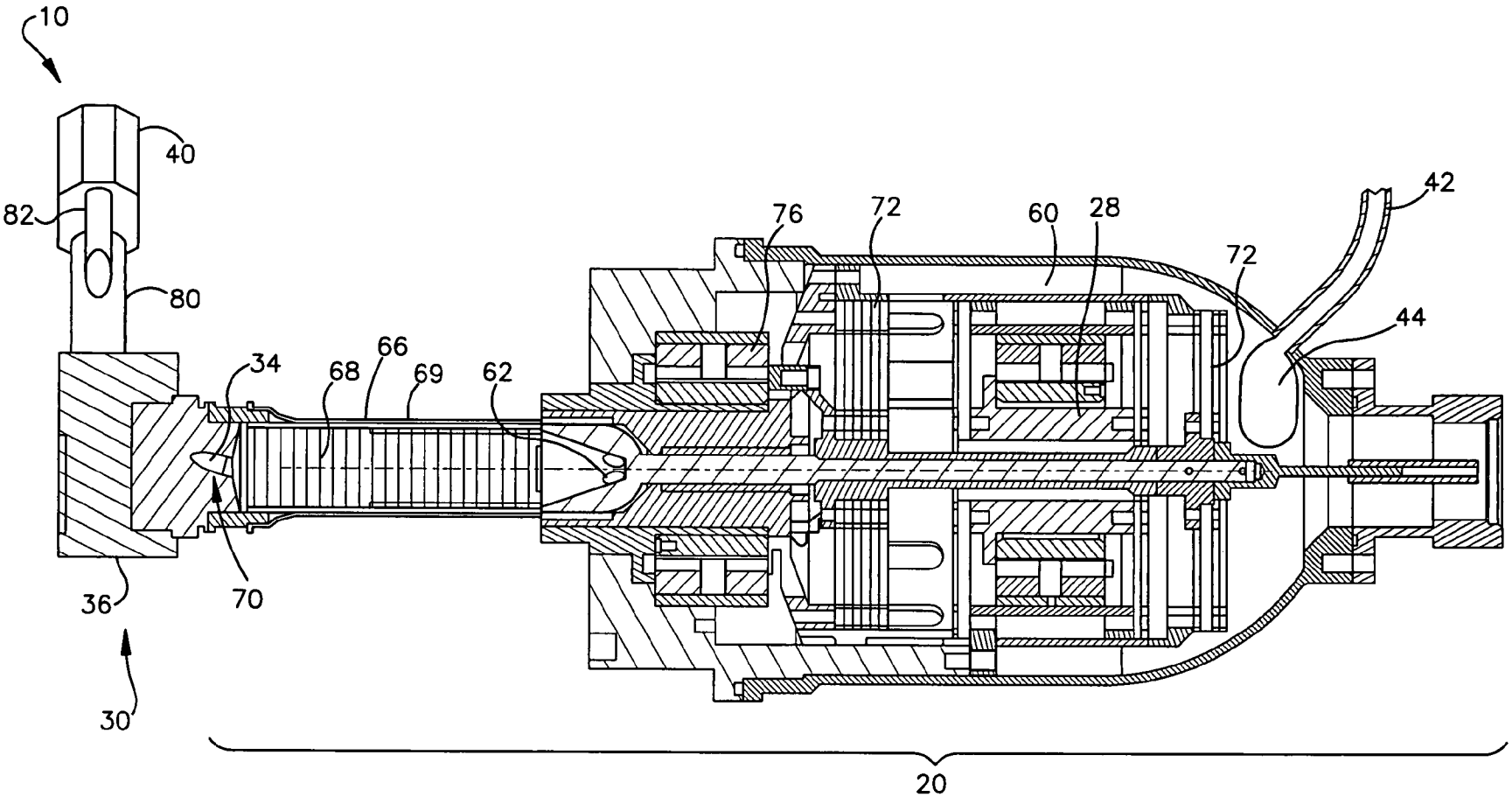
FIG. 7 is a sectional view of another specific embodiment of a Stirling expander for use in the cryocooler of FIG. 5.

FIG. 5 shows an alternate embodiment of the cryocooler 10. In an embodiment shown in FIG. 5, the surge volume 44 is placed at least partially within the Stirling expander 20. For instance, the plenum 60 (FIG. 2) may itself be utilized as the surge volume 44, as illustrated in FIG. 6. Alternatively, the surge volume 44 may be an isolated structure, taking up part of the plenum 60, within a pressure containment housing 90 of the Stirling expander 20. This configuration is illustrated in FIG. 7.

It will be appreciated that, as another alternative, the surge volume 44 may placed at least partially within the compressor 26. The placement of the surge volume 44 within the compressor 26 or the expander 20 may facilitate meeting design and/or packaging requirements.

Figure 8:
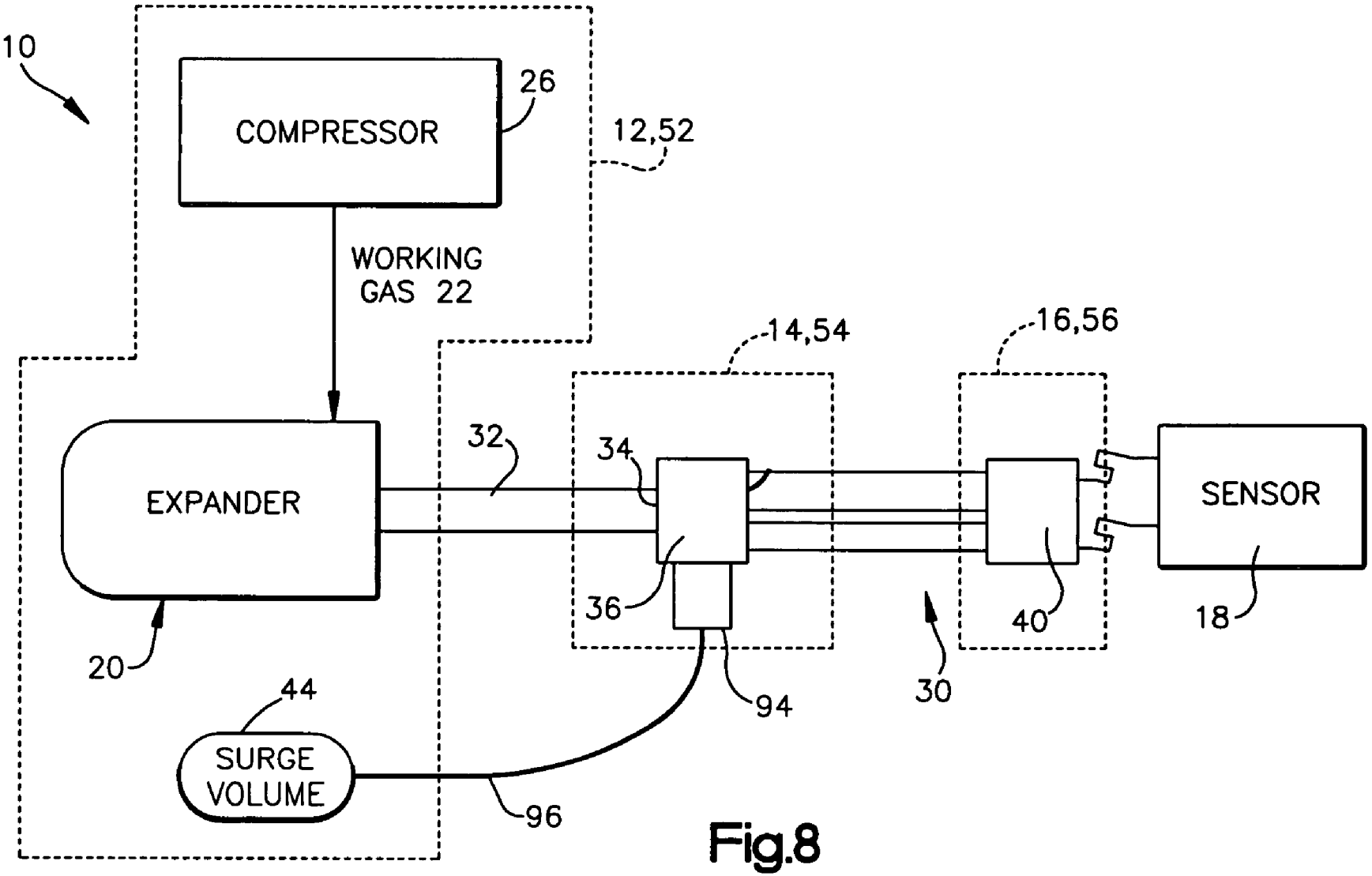
FIG. 8 is a schematic diagram of yet another embodiment of a cryocooler in accordance with the present invention.

Another alternative for the cryocooler 10 is shown in FIG. 8. As shown therein, the inertance tube 42 (FIG. 1) is replaced by a phase shifter 94 and a connecting flow line 96. The phase shifter may be any of a variety of suitable devices, such as an orifice, a porous plug, or an active device, to provide the desired phase shift between the mass flow rate and the pressure wave at the cold end of the pulse tube 30.

The phase shifter 94 alters mass flow distribution to the surge volume 44. It will be appreciated that by varying the stroke and/or phase angle of the displacer 66 in the first-stage expander 20, and by means of the inertance tube 42 and/or the phase shifter 94 (in conjunction with the surge volume 44), performance may be optimized at any operating point, including on orbit and in an actual thermal environment of a space craft, for example.

Figure 9:
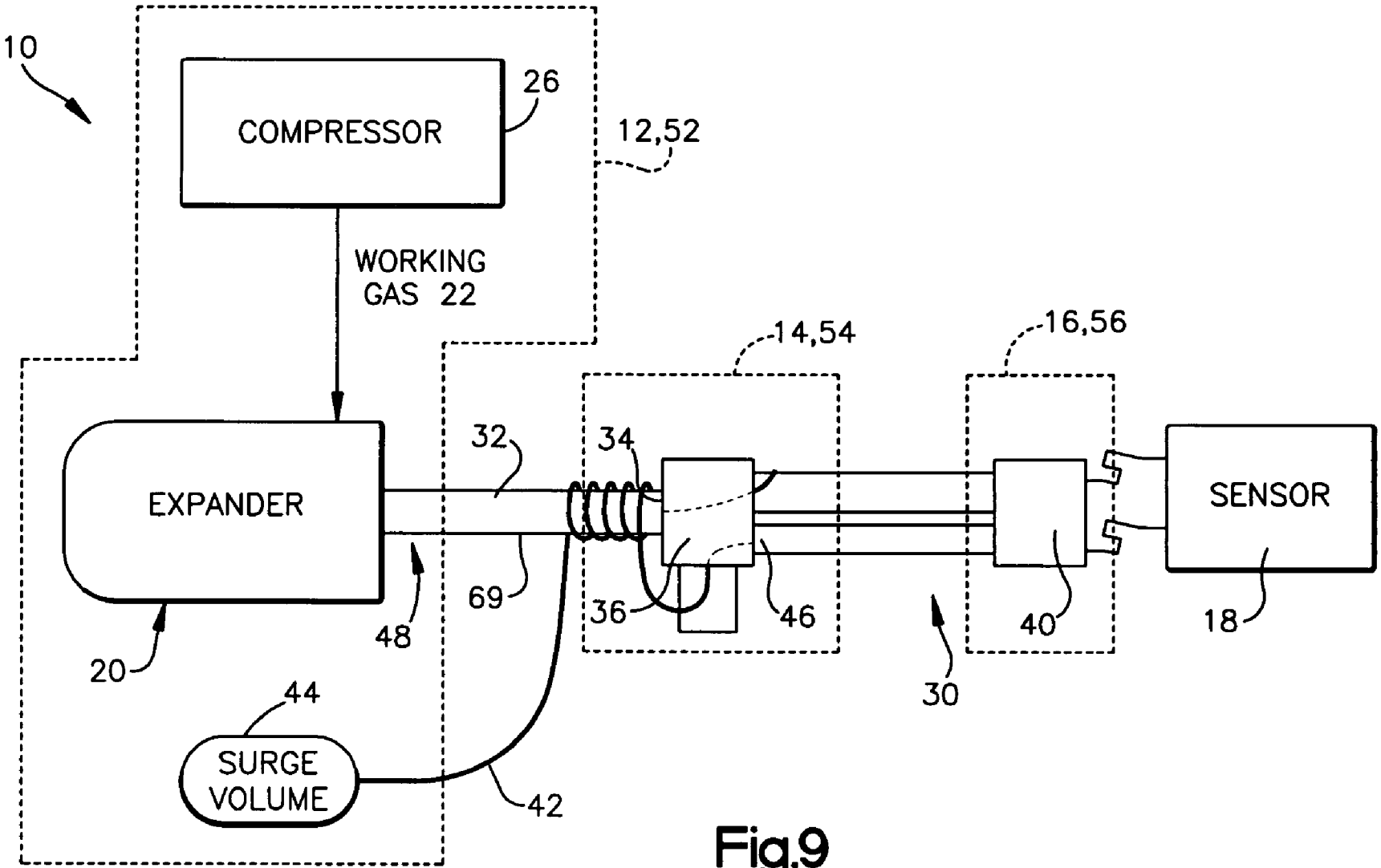
FIG. 9 is a schematic diagram of still another embodiment of a cryocooler in accordance with the present invention.

FIG. 9 shows another embodiment of the cryocooler 10. In the embodiment shown in FIG. 9, the inertance tube 42 is thermally coupled to the cold cylinder 69, for example by being wrapped around the cold cylinder 69. This thermal coupling between the inertance tube 42 and the cold cylinder 69 may reduce heat transfer from the warm end of the inertance tube 42 to the cold end of the inertance tube 42, which may be caused by oscillatory movement of gas in the inertance tube 42. The thermal coupling between the inertance tube 42 and the cold cylinder 69 may be accomplished by any of a variety of ways. For example, the heat sinking between the inertance tube 42 and the cold cylinder 69 may be accomplished by coupling them together at one point, at several distinct points, or essentially continuously along at least part of the length of the inertance tube 42 (as with the embodiment shown in FIG. 9).

From the foregoing, it will be appreciated that placing a surge volume in the ambient temperature portion of a multistage cryocooler results in several benefits, such as increasing performance, reducing mechanical stresses, and allowing easier integration of the cryocooler into systems such as space craft. In addition, the combination of an inertance tube for phase shifting and a surge volume for achieving thermal isolation may itself be beneficial for multistage cryocoolers that utilize a Stirling expander and a pulse tube expander.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hybrid multistage cryocooler comprising:

a first-stage expander having a first-stage expander outlet;

a first-stage thermal interface;

a second-stage expander in communication with the first-stage expander outlet, via the first-stage thermal interface; and a surge volume in communication with a second-stage expander outlet of the second-stage expander, via the first-stage thermal interface;

wherein the surge volume is maintained at an ambient temperature.

2. The cryocooler of claim 1, further comprising an inertance tube coupling the surge volume to the first-stage thermal interface.

3. The cryocooler of claim 2, wherein a first end of the inertance tube is at the ambient temperature, and wherein a second end of the inertance tube is at a first-stage temperature that is lower than the ambient temperature.

4. The cryocooler of claim 2, wherein the inertance tube is thermally coupled to a cold cylinder surrounding an expansion volume that is in gaseous communication with the first-stage expander outlet.

5. The cryocooler of claim 1, wherein the first-stage expander is a Stirling expander.

6. The cryocooler of claim 5, wherein the Stirling expander includes:

a cold cylinder surrounding an expansion volume that is in gaseous communication with the first-stage expander outlet;

a displacer which forces a working gas through the expansion volume and a first-stage regenerator; and a motor that drives the displacer.

7. The cryocooler of claim 1, wherein the second-stage expander is a pulse tube expander.

8. The cryocooler of claim 7, wherein the pulse tube expander includes:

a pulse tube inlet;

a pulse tube gas volume in gaseous communication with the pulse tube inlet, the gas volume including a second-stage regenerator and a pulse tube gas column; and a second-stage heat exchanger in thermal communication with the second-stage regenerator and the pulse tube gas column.

9. The cryocooler of claim 1, wherein the first-stage thermal interface is maintained at a first-stage cold temperature that is lower than the ambient temperature.

10. The cryocooler of claim 9, wherein the first-stage thermal interface is coupled to an expansion volume of the first-stage expander.

11. The cryocooler of claim 10, further comprising an inertance tube coupling the surge volume to the first-stage thermal interface.

12. The cryocooler of claim 10, wherein the first-stage thermal interface is cantilevered off the expansion volume.

13. The cryocooler of claim 1, wherein the surge volume is within the Stirling expander.

14. The cryocooler of claim 1, wherein the surge volume is inside at least part of a plenum of the Stirling expander.

15. The cryocooler of claim 1, further comprising an ambient-stage structure;

wherein the surge volume and at least the first-stage expander are mechanically coupled to the ambient-stage structure.

16. A hybrid multistage cryocooler comprising:

a first-stage expander having a first-stage expander outlet;

a first-stage thermal interface;

a second stage in communication with the first-stage expander outlet, via the first-stage thermal interface;

a surge volume in communication with a second-stage expander, via the first-stage thermal interface; and an inertance tube coupling the surge volume to the first-stage thermal interface;

wherein the surge volume is maintained at an ambient temperature;

wherein a first end of the inertance tube is at the ambient temperature, wherein a second end of the inertance tube is at a first-stage temperature that is lower than the ambient temperature;

wherein the first-stage expander is a Stirling expander;

wherein the first-stage thermal interface is coupled to an expansion volume of the first-stage expander; and wherein the first-stage thermal interface is cantilevered off the expansion volume.

17. The cryocooler of claim 16, wherein the surge volume is within the Stirling expander.

18. The cryocooler of claim 16, wherein the surge volume is in at least part of a plenum of the Stirling expander.

19. The cryocooler of claim 16, further comprising an ambient-stage structure; and wherein the surge volume and at least the first-stage expander are mechanically coupled to the ambient-stage structure.

20. A method of cooling, comprising:

providing a first-stage expander having a first-stage expander outlet;

providing a first-stage thermal interface;

providing a second-stage cooler in communication with the first-stage expander outlet, via the first-stage thermal interface; and coupling a surge volume in communication with the first-stage expander outlet and the second-stage cooler, via the first-stage thermal interface, wherein the coupling includes placing the surge volume such that the surge volume is maintained at an ambient temperature.

21. The cryocooler of claim 1, wherein the first-stage thermal interface is at a first-stage temperature that is lower than the ambient temperature.

* * * * *